US006968819B2

(12) United States Patent
Fujii et al.

(10) Patent No.: US 6,968,819 B2
(45) Date of Patent: Nov. 29, 2005

(54) VARIABLE VALVE ACTUATING DEVICE

(75) Inventors: Noriaki Fujii, Wako (JP); Katsunori Nakamura, Wako (JP); Keiko Yoshida, Wako (JP); Hisao Sakai, Wako (JP); Tadaharu Shoji, Wako (JP); Motohiro Maruyama, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/028,608

(22) Filed: Jan. 5, 2005

(65) Prior Publication Data

US 2005/0150472 A1 Jul. 14, 2005

(30) Foreign Application Priority Data

Jan. 9, 2004 (JP) ..... P 2004-004691

(51) Int. Cl.[7] ..... F01L 1/18
(52) U.S. Cl. ..... 123/90.44; 123/90.39; 123/90.16; 123/90.2
(58) Field of Search ..... 123/90.39, 90.41, 123/90.44, 90.2, 90.25, 90.26, 90.16; 74/559, 74/567, 569

(56) References Cited

U.S. PATENT DOCUMENTS

| | | | | |
|---|---|---|---|---|
| 3,626,469 | A * | 12/1971 | Ashley | 123/90.25 |
| 6,854,434 | B2 * | 2/2005 | Methley | 123/90.16 |
| 6,874,456 | B2 * | 4/2005 | Yamada et al. | 123/90.36 |

FOREIGN PATENT DOCUMENTS

| | | |
|---|---|---|
| JP | 2002-364317 | 12/2002 |
| JP | 2003-3811 | 1/2003 |

* cited by examiner

*Primary Examiner*—Thomas Denion
*Assistant Examiner*—Ching Chang
(74) *Attorney, Agent, or Firm*—Armstrong, Kratz, Quintos, Hanson & Brooks, LLP

(57) ABSTRACT

To allow both the valve lift and valve timing for an engine valve to be varied in a continuous manner, the variable valve actuating device (1) comprises a camshaft (8) rotatably supported by a fixed part of the engine and provided with a cam (7), a first rocker arm (9) pivotally supported by a fixed part of the engine, the first rocker arm being provided with a first point (12) engaging a stem of an engine valve (6), a drum (11) rotatably supported by a fixed part of the engine and at least partly surrounding the cam, a second rocker arm (10) having a first point (20) pivotally supported by the drum, a second point (21) adapted to engage the cam and a surface engaged by a second point (22) of the first rocker arm, and a control member (25, 26) for selectively turning the drum over a prescribed angular range.

5 Claims, 5 Drawing Sheets

VARIABLE VALVE ACTUATING DEVICE

TECHNICAL FIELD

The present invention relates to a device for varying the valve actuation property of engine valves, and in particular to a device for varying the timing and lift of the intake valves of an internal combustion engine in a continuous manner.

BACKGROUND OF THE INVENTION

Japanese patent laid open publication No. 2002-364317 filed by the assignee of the present application discloses a device for varying the lift of the intake valves of an internal combustion engine in a continuous manner. In this device, a worm connected to an output shaft of an electric motor meshes with a sector worm wheel which in turn rotates a lever directly connected thereto. The lever is configured in such a manner that the transmission ratio of the cam lift to the valve lift is varied in dependence on the angular position of the lever. This allows the valve lift to be varied in a continuous manner, but does not allow the opening timing of the valves to be varied. Therefore, when the valve lift is reduced in a low-speed, low-load state, the intake valves remain substantially closed in an early stage of each intake stroke of the piston and this undesirably increases a pumping loss in the intake stroke.

To enable the timing of the intake valves to be varied also, Japanese patent laid open publication No. 2003-003811 discloses the use of a camshaft including a cam whose profile varies in the axial direction and an actuating device that can selectively move the camshaft in the axial direction. This allows both the lift and timing of the engine valve to be varied in a continuous and smooth manner particularly if a ball spline or roller spline is used for the sliding surface of the cam.

However, as this prior proposal depends on a highly complex cam profile for achieving a desired valve timing and lift, a considerable expense is required to manufacture such a camshaft. Also, a drive mechanism for moving the cam is required to be provided in association with the camshaft, and this also adds to the complexity and manufacturing cost of the valve actuating device.

BRIEF SUMMARY OF THE INVENTION

In view of such problems of the prior art, a primary object of the present invention is to provide a variable valve actuating device which allows both the valve lift and valve timing for an engine valve to be varied in a continuous manner without unduly increasing the complexity and manufacturing cost of the valve actuating device.

A second object of the present invention is to provide a variable valve actuating device which allows the valve lift and valve timing for an engine valve to be varied in a desired manner so as to optimize the performance of the engine.

According to the present invention, such objects can be accomplished by providing a variable valve actuating device for transmitting a cam lift to a valve lift at a variable ratio and by a variable phase relationship in an internal combustion engine, comprising: a camshaft rotatably supported by a fixed part of the engine and provided with a cam; a first rocker arm pivotally supported by a fixed part of the engine, the first rocker arm being provided with a first point engaging a stem of an engine valve; a drum rotatably supported by a fixed part of the engine and at least partly surrounding the cam; a second rocker arm having a first point pivotally supported by the drum, a second point adapted to engage the cam and a surface engaged by a second point of the first rocker arm; and a control member for selectively turning the drum over a prescribed angular range.

Thus, whereas the second point of the second rocker arm moves by a prescribed stroke as determined by the lift of the cam, the first rocker arm can be made to rotate at a variable angular stroke as determined by the position at which the second point of the first rocker arm engages the second rocker arm (owing to the turning of the drum), and this in turn means that the valve lift can be varied because the angular stroke of the first rocker arm dictates the lift of the valve. Because the turning of the drum also changes the angular phase relationship between the second rocker arm including the second point thereof and cam, the angular phase relationship between the camshaft and valve lift is varied at the same time. As can be readily appreciated by a person skilled in the art, the drum as used means any member that is able to pivotally support the second rocker arm and allow an appropriate point of the second rocker arm to engage the corresponding cam provided on the camshaft, and is not necessarily required to be shaped like a drum or to be otherwise cylindrical in shape.

The present invention can most readily improve the performance of the engine when applied to the intake valve thereof. Typically, an exhaust valve drive cam is provided immediately next to the intake valve drive cam on the camshaft. To enable the drum to be supported in a stable manner, the drum preferably extends axially across the intake and exhaust valve drive cams. In such a case, the drum may be provided with an opening that exposes the exhaust valve drive cam so that the rocker arm for the exhaust valve may be enabled to engage the exhaust valve drive cam without being interfered by the drum.

According to a preferred embodiment of the present invention, the drum and cam shaft are rotatably supported by a common camshaft holder in a coaxial relationship so that the number of the necessary components may be minimized and the space requirement may be minimized. The turning of the drum can be most readily accomplished by providing a gear formed round the drum and a control rod formed with a pinion that meshes with the gear and connected to a power source such as an output shaft of an electric motor.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
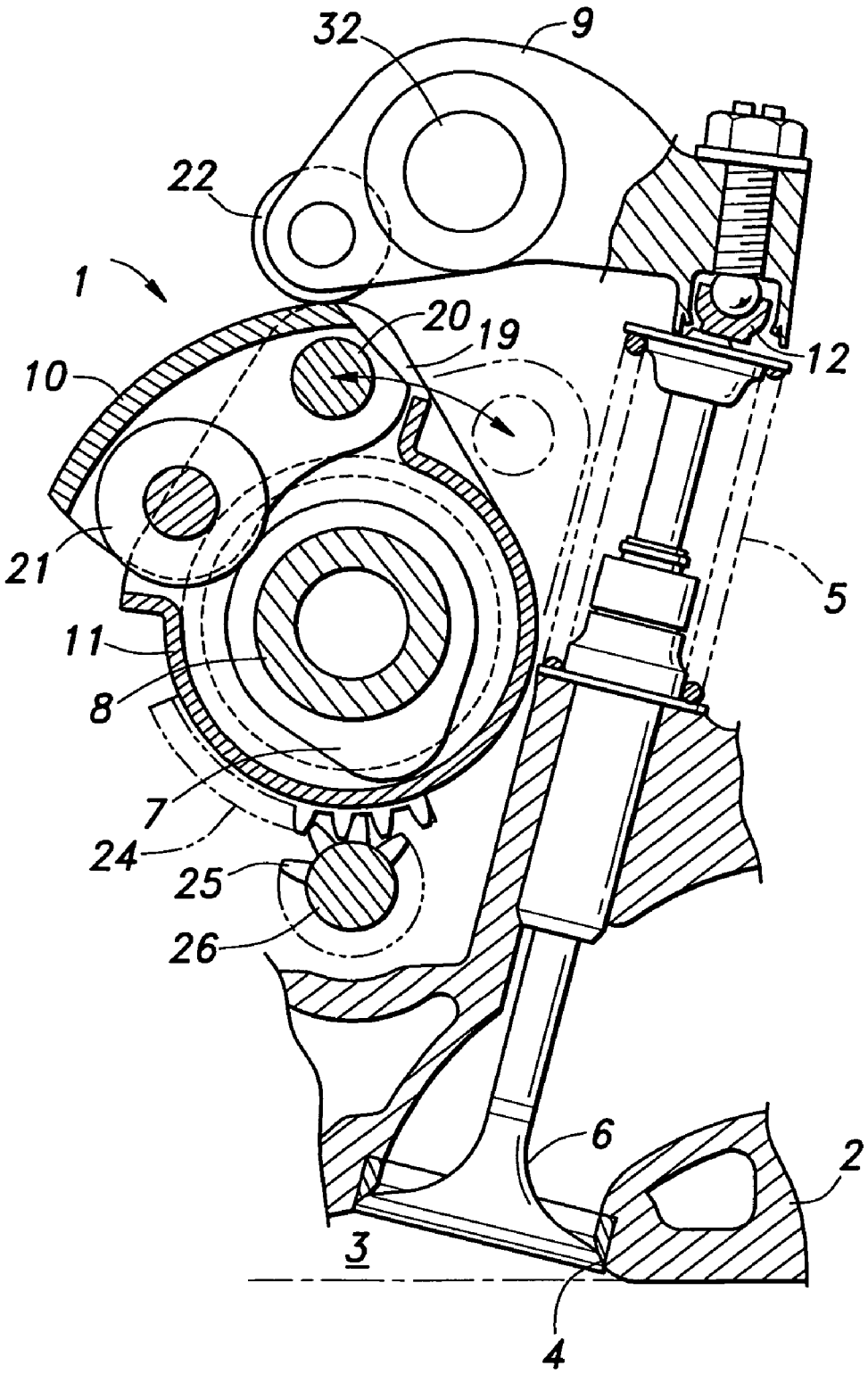
FIG. 1 is a partly broken away side view of a valve actuating device embodying the present invention.
Figure 2:
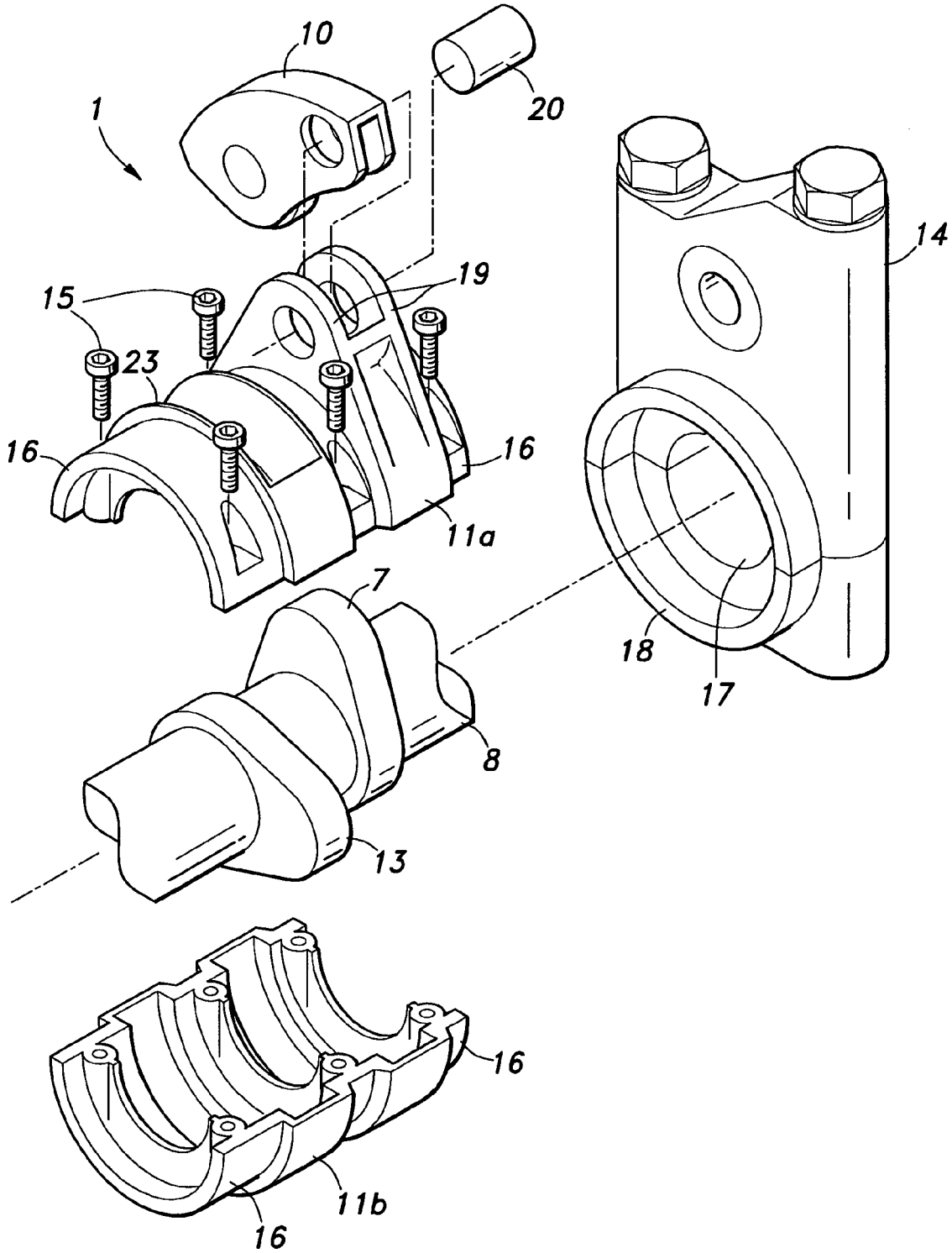
FIG. 2 is a fragmentary exploded perspective view of the valve actuating device.

Referring to FIGS. 1 and 2, the illustrated variable valve actuating device 1 embodying the present invention comprises an intake valve 6 for selectively opening and closing an intake port 4 of a combustion chamber 3 defined in a cylinder head 2 of an internal combustion engine, a camshaft 8 formed with an intake valve drive cam 7 for actuating the intake valve 6, a pair of rocker arms 9 and 10 for jointly transmitting the lift of the cam 7 to the intake valve 6 and a drum 11 supported by the cylinder head 2 so as to be rotatable around the axial line of the camshaft 8 as described hereinafter. The drum 11 surrounds the camshaft 8 so as to permit the rotation of the cam 7 therein.

The intake valve 6, camshaft 8, cam 7 and one of the rocker arms 9 having a tappet member 12 at one end for engaging the stem end of the intake valve 6 may be essentially based on the conventional design.

The camshaft 8 is additionally formed with an exhaust valve drive cam 13 axially next to the intake valve drive cam 7, and is rotatably supported by a plurality of camshaft holders 14 that are fixedly attached to the cylinder head 2 by threaded bolts. Only one of the camshaft holders 14 is illustrated in the drawings.

Cylindrical portions or journal portions formed on either axial end of the camshaft 8 are supported by the corresponding journal bearings 17 provided in the camshaft holders 14. The drum 11 surrounding the camshaft 8 consists of two halves 11*a* and 11*b* that are joined to each other by threaded bolts. The drum 11 is also provided with a pair of cylindrical portions or journal portions 16 on either axial end thereof that are rotatably supported by bearing bosses 18 provided in the camshaft holders 14 coaxially with the bearings 17 for the camshaft 8.

The second rocker arm 10 is provided with a pairs of side walls, a trunnion pin 20 extending across the side walls at an end of the second rocker, arm 10 adjacent to the first rocker arm 9 and a roller cam follower 21 rotatably supported at the other end of the second rocker arm 10 remote from the first rocker arm 9. The trunnion pin 20 is rotatably supported by a pair of ear pieces 19 integrally formed on the outer periphery of the drum 11, and the roller cam follower 21 engages the intake valve drive cam 7. The outer or upper surface of the second rocker arm 10 defines an arcuate convex surface that is engaged by the end of the first rocker arm 9 provided with a roller follower 22, opposite to the end provided with the tappet member 12. An intermediate point of the first rocker arm 9 is supported by a rocker shaft 32.

A part of the outer wall of the drum 11 opposing the exhaust valve drive cam 13 defines an opening 23 to expose the cam and permit the lift of the cam to be transmitted to the exhaust valve via a rocker arm not shown in the drawings. A lower peripheral part of the drum 11 is provided with a sector gear 24 centered around the axial center of the drum 11 or the camshaft 8 and extending over an angular range of about 90 degrees. A control shaft 26 rotatably supported by the cylinder head 2 is provided with a pinion 25 that meshes with the sector gear 24. The other axial end of the control shaft 26 extends through a wall extending from the cylinder head 2 and is adapted to be rotatively driven by a drive unit provided externally of the cylinder head 2.

Figure 3:
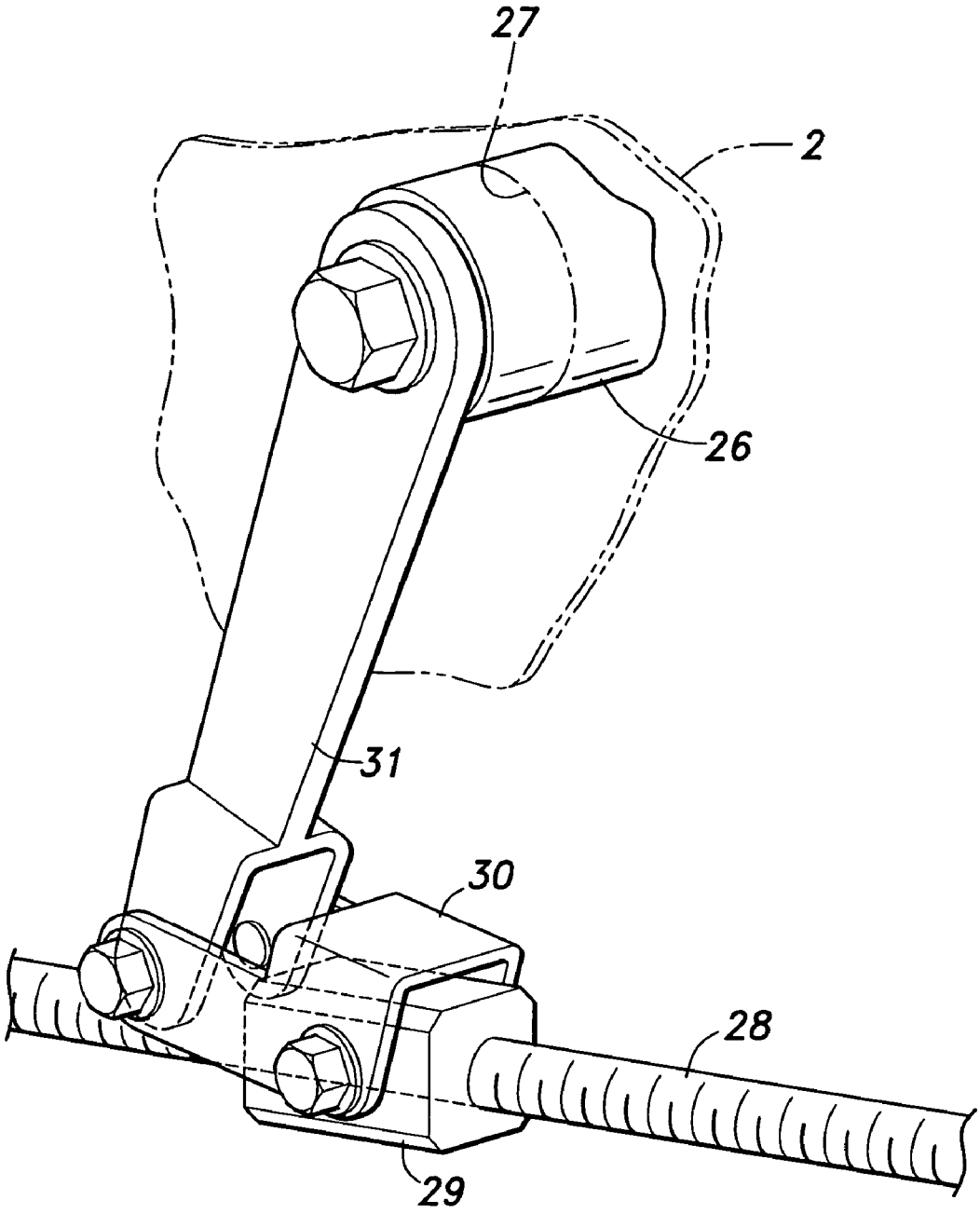
FIG. 3 is a perspective view of the arrangement for actuating the control shaft.

As illustrated in FIG. 3, the drive unit for turning the control shaft 26 comprises a threaded rod 28 adapted to be turned by an electric motor not shown in the drawings, a nut member 29 threadably engaged by the threaded rod 28, a connecting link 30 having an end pivotally attached to the nut member 29 and a control arm 31 having a base end fixedly attached to the axial end of the control shaft 26 and a free end pivotally connected to the other end of the connecting link 30.

As can be appreciated from the foregoing description, the first and second rocker arms 9 and 10 cooperate with each other in such a manner that the point of contact between the first rocker arm 9 and second rocker arm 10 can be varied by turning the drum 11. In particular, the point of contact can be varied along the length of the second rocker arm 10, from a point adjacent to the trunnion pin 20 (the pivot center of the second rocker arm 10) to a point near the roller cam follower 21 (that engages the cam 7). At the same time, the point of engagement between the roller cam follower 21 and cam 7 moves angularly along the circumference of the camshaft 8. Therefore by varying the point of contact along the length of the second rocker arm 10 by turning the drum 11, the ratio by which the lift of the cam 7 is transmitted to the first rocker arm 9 can be varied. At the same time, the lift of the cam 7 is transmitted to the first rocker arm 9 at a variable angular phase relationship.

Figure 4B:
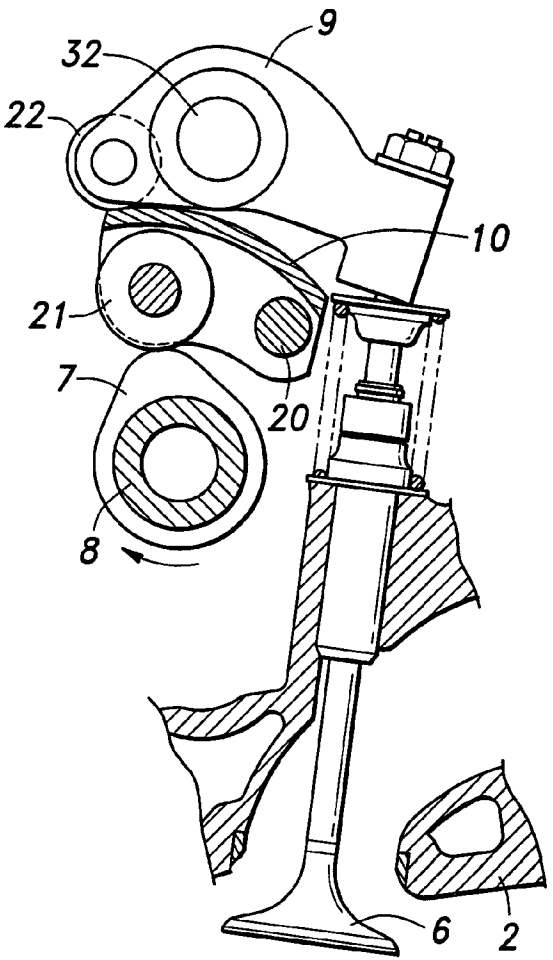
FIGS. 4*a* and 4*b* are views similar to FIG. 1 showing different states of the second rocker arm.
Figure 4A:
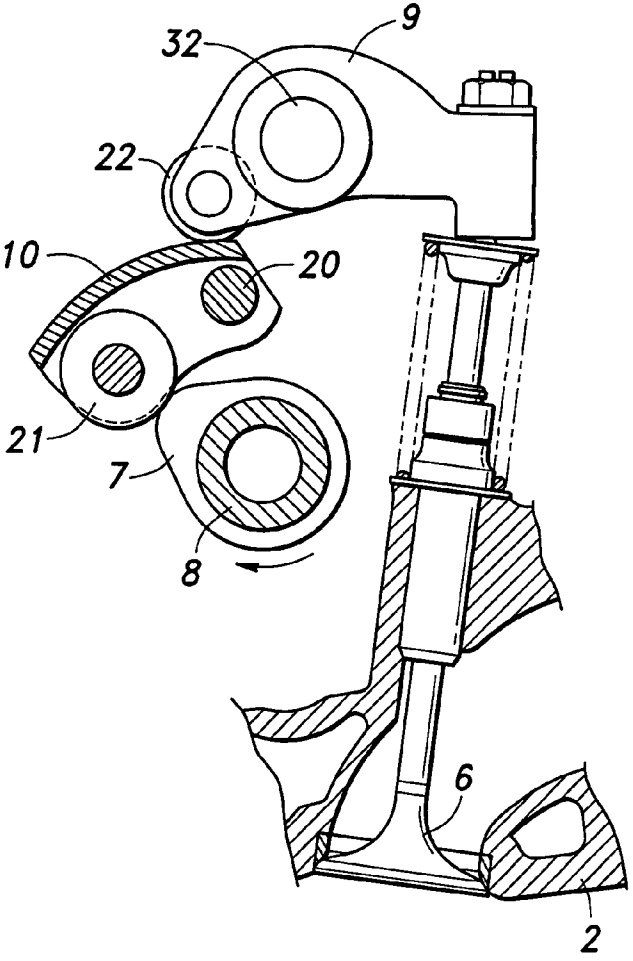

When the drum 11 is turned to an angular position such that the point of contact between the first rocker arm 9 and second rocker arm 10 is adjacent to the trunnion pin 20 and most remote from the point of engagement between the second rocker arm 10 and cam 7 as illustrated in FIG. 4*a*, the transmission ratio of the lift of the cam 7 to the lift of the intake valve 6 is at a minimum value. Even though the cam follower 21 moves by a full stroke by being actuated by the cam 7, the point of contact between the first rocker arm 9 and second rocker arm 10 is so close to the pivot center or the trunnion pin 20 that the angular displacement of the first rocker arm 9 is extremely small or even nil. Therefore, the lift of the intake valve 6 in this case is extremely small or even nil.

When the drum 11 is turned to another extreme angular position such that the point of contact between the first rocker arm 9 and second rocker arm 10 is most remote from the trunnion pin 20 and most adjacent to the point of engagement between the second rocker arm 10 and cam 7 as illustrated in FIG. 4*b*, the transmission ratio of the lift of the cam 7 to, the lift of the intake valve 6 is at a maximum value. In this case, the lift of the cam 7 is transmitted to the first rocker arm 9 substantially without being diminished.

Furthermore, the angular position of the camshaft 8 at the time of the maximum opening lift of the intake valve 6 is most advanced when the opening lift of the intake valve 6 is at the minimum. In other words, both the opening timing and lift of the intake valve 6 can be varied simultaneously in a continuous manner.

Thus, according to the illustrated variable valve actuating device 1, the drum 11 supporting the second rocker arm 10 can change its angular position continuously between the position illustrated in FIG. 4*a* for achieving a minimum valve lift and the position illustrated in FIG. 4*b* for achieving a maximum valve lift. This causes the point of contact at which the roller follower 20 of the first rocker arm 9 engages the second rocker arms 10 to continually vary between the point adjacent to the trunnion pin 20 and the point most remote therefrom. This changes the angular displacement of the first rocker arm 9 and hence the lift of the intake valve 6 even though the angular displacement of the second rocker arm 10 remains unchanged.

At the same time, the timing of opening the intake valve 6 is delayed as the drum is turned in the direction to increase the valve lift.

Figure 5:
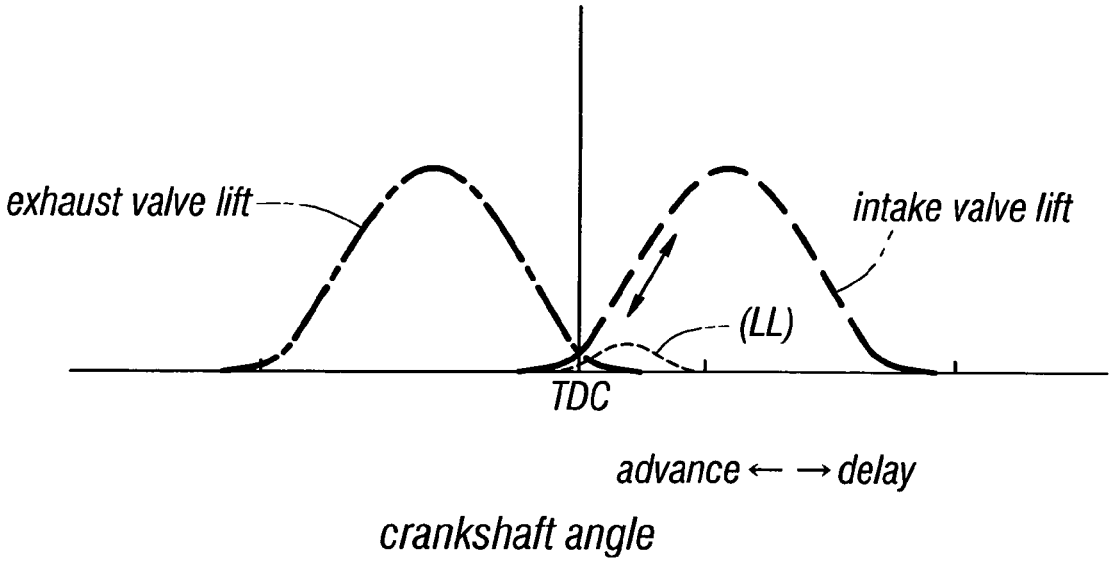
FIG. 5 is a graph showing the relationship between the crankshaft angle and valve lift.

Thereby, as illustrated in FIG. 5, the valve lift can be increased and opening timing can be delayed in a high speed range so as to minimize resistance to intake flow, and the valve lift can be decreased and opening timing can be advanced in a low speed range so as to minimize the pumping loss and improve fuel economy.

By suitably selecting the configuration of the second rocker arm 10, the changes in the valve lift and valve opening timing in relation to the crankshaft angle can be freely selected sodas to match the particular engine configuration.

The drum 11 is turned owing to the meshing of the pinion 25 formed on the control shaft 26 with the sector gear 24 formed in a lower face of the drum 11. Because this meshing part may be dipped in a well of lubricating oil formed in the cylinder head 2, no additional lubricating arrangement is required.

The reaction force of the valve spring 5 that is applied to the second rocker arm 10 may become unacceptably small in a low valve lift range, and this may cause an undesired action of the second rocker arm 10. It can be avoided, for instance, by providing a torsion coil spring on the trunnion pin 20 to resiliently urge the cam follower 21 against the outer surface of the cam 7.

Also, by providing an offset between the rotational centers of the camshaft 8 and drum 11 and/or suitably defining the curvature of the surface of the second rocker arm 10 that engages the roller follower 22 of the first rocker arm 9, the variable valve actuating device 1 can be adapted to various valve actuating properties and tappet clearance settings.

Although the present invention has been described in terms of a preferred embodiment thereof, it is obvious to a person skilled in the art that various alterations and modifications are possible without departing from the scope of the present invention which is set forth in the appended claims. For instance, the present invention is not limited to the particular mode of rocker arms in the illustrated embodiment. For instance, although the rocker shaft 32 for the first rocker arm 9 was located at a point intermediate between the tappet member 12 and roller follower 22 in the illustrated embodiment, the rocker shaft or other means for pivotal support may also be provided on one end of the rocker arm. Such variations of the positioning of the pivotal point, tappet member (or other member for engaging the stem of the intake valve 6) and roller follower (or other member for engaging the second rocker arm 10) on the first rocker arm 9 are all within the scope of the present invention. Similarly, for the second rocker arm 10, the placement of the pivotal point, surface of contact with the first rocker arm 9 and point of engagement with the cam 7 can be varied at will without departing from the spirit of the present invention.

What is claimed is:

1. A variable valve actuating device for transmitting a cam lift to a valve lift at a variable ratio and by a variable phase relationship in an internal combustion engine, comprising:

a camshaft rotatably supported by a fixed part of the engine and provided with a cam;

a first rocker arm pivotally supported by a fixed part of the engine, the first rocker arm being provided with a first point engaging a stem of an engine valve;

a drum rotatably supported by a fixed part of the engine and at least partly surrounding the cam;

a second rocker arm having a first point pivotally supported by the drum, a second point adapted to engage the cam and a surface engaged by a second point of the first rocker arm; and a control member for selectively turning the drum over a prescribed angular range.

2. A variable valve actuating device according to claim 1, wherein the engine valve consists of an intake valve.

3. A variable valve actuating device according to claim 1, wherein the drum and cam shaft are rotatably supported by a common camshaft holder in a coaxial relationship.

4. A variable valve actuating device according to claim 1, further comprising a gear formed around the drum, and the control member includes a pinion that meshes with the gear.

5. A variable valve actuating device according to claim 2, wherein the camshaft further comprises a cam for actuating an exhaust valve, and the drum is provided with an opening that exposes the cam for the exhaust valve.

* * * * *